US010377549B2

(12) United States Patent
De Muinck

(10) Patent No.: US 10,377,549 B2
(45) Date of Patent: Aug. 13, 2019

(54) FOLDABLE BAG AND A METHOD OF MANUFACTURING A FOLDABLE BAG

(75) Inventor: Ebo Jacques De Muinck, Loenen aan de Vecht (NL)

(73) Assignee: Scholle IPN Corporation, Northlake, IL (US)

( * ) Notice: Subject to any disclaimer, the term of this patent is extended or adjusted under 35 U.S.C. 154(b) by 1016 days.

(21) Appl. No.: 13/266,902

(22) PCT Filed: Apr. 29, 2010

(86) PCT No.: PCT/EP2010/055838

§ 371 (c)(1),
(2), (4) Date: Mar. 13, 2012

(87) PCT Pub. No.: WO2010/125152

PCT Pub. Date: Nov. 4, 2010

(65) Prior Publication Data

US 2012/0163737 A1 Jun. 28, 2012

(30) Foreign Application Priority Data

Apr. 29, 2009 (EP) ..... 09159051

(51) Int. Cl.
*B65D 77/00* (2006.01)
*B65D 77/06* (2006.01)
(Continued)

(52) U.S. Cl.
CPC ..... *B65D 77/06* (2013.01); *B65D 31/10* (2013.01); *B31B 2150/00* (2017.08); *B31B 2150/0012* (2017.08); *B31B 2160/20* (2017.08)

(58) Field of Classification Search
CPC ..... Y10S 383/906; B29C 65/00; B31B 37/00; B65D 88/1618; B65D 77/06
(Continued)

(56) References Cited

U.S. PATENT DOCUMENTS 388,612 A 8/1888 Appel
2,556,661 A 6/1951 Rendall et al.
(Continued)

FOREIGN PATENT DOCUMENTS

AU 529320 B2 6/1983
DE U9316120.4 8/1955
(Continued)

OTHER PUBLICATIONS

European Search Report and the Written Opinion of the European Patent Office Patent Office in counterpart foreign application No. PCT/EP2010/055838 filed Apr. 29, 2010.
(Continued)

*Primary Examiner* — Peter N Helvey
(74) *Attorney, Agent, or Firm* — The Watson IP Group, PLC; Jovan N. Jovanovic

(57) ABSTRACT

A foldable bag comprises a front sheet and a back sheet which are circumferentially joined to each other. The bag is disposed in a folded condition in which the bag has a reversed T-shape including a bottom and an upward portion extending upwardly from the bottom. In the folded condition of the bag, upward portion side edges are inwardly creased between the front sheet and the back sheet such that they face to each other. At the bottom, an inner bottom edge portion extends substantially within a plane of the upward portion and each of outer bottom edge portions extend substantially parallel above the inner bottom edge portion.

11 Claims, 7 Drawing Sheets

(51) Int. Cl.
*B65D 30/20* (2006.01)
*B31B 150/00* (2017.01)
*B31B 160/20* (2017.01)

(58) Field of Classification Search
USPC ..... 383/105, 120, 121, 123–126
See application file for complete search history.

(56) References Cited

U.S. PATENT DOCUMENTS

| | | | | | |
|---|---|---|---|---|---|
| 2,556,707 | A | | 6/1951 | Rendall et al. | |
| 3,023,679 | A | | 3/1962 | Piazze | |
| 3,089,622 | A | | 5/1963 | Westlake, Jr. | |
| 3,143,249 | A | | 8/1964 | Merrill et al. | |
| 3,244,576 | A | * | 4/1966 | Swartz | 156/513 |
| 3,266,710 | A | * | 8/1966 | Reeves | 383/92 |
| 3,496,059 | A | | 2/1970 | Ole-Bendt | |
| 3,827,341 | A | | 8/1974 | Stage | |
| 3,896,714 | A | | 7/1975 | Bosse | |
| 3,942,416 | A | | 3/1976 | Ackley et al. | |
| 4,011,798 | A | * | 3/1977 | Bambara et al. | 493/240 |
| 4,088,264 | A | * | 5/1978 | Vogt | 383/111 |
| 4,450,180 | A | * | 5/1984 | Watkins | 426/107 |
| 4,524,459 | A | * | 6/1985 | Titchenal | 383/37 |
| 4,561,107 | A | * | 12/1985 | Herder | 383/37 |
| 4,596,040 | A | * | 6/1986 | LaFleur et al. | 383/7 |
| 4,712,684 | A | * | 12/1987 | Boeckmann | 206/554 |
| 4,783,178 | A | * | 11/1988 | Herder | 383/120 |
| 4,859,082 | A | * | 8/1989 | Llorens et al. | 383/8 |
| 4,866,786 | A | | 9/1989 | Nagler | |
| 4,889,523 | A | | 12/1989 | Sengewald | |
| 4,974,966 | A | * | 12/1990 | Fabbi | 383/1 |
| 5,005,726 | A | * | 4/1991 | Robbins | 222/530 |
| 5,028,197 | A | * | 7/1991 | Krein et al. | 414/467 |
| 5,050,755 | A | | 9/1991 | Marquardt | |
| 5,059,084 | A | * | 10/1991 | Krein | 414/467 |
| 5,067,636 | A | | 11/1991 | Pfeiffer et al. | |
| 5,096,305 | A | * | 3/1992 | Rimondi et al. | 383/37 |
| 5,102,384 | A | | 4/1992 | Ross et al. | |
| 5,104,236 | A | * | 4/1992 | LaFleur | 383/17 |
| 5,149,315 | A | | 9/1992 | Muhs | |
| 5,188,460 | A | * | 2/1993 | Dorse | 383/18 |
| 5,230,689 | A | * | 7/1993 | Derby | 493/210 |
| 5,344,048 | A | * | 9/1994 | Bonerb | 222/105 |
| 5,350,239 | A | * | 9/1994 | Strand et al. | 383/7 |
| 5,673,664 | A | | 10/1997 | Lassanske | |
| 5,752,613 | A | | 5/1998 | Sasaki et al. | |
| 5,759,144 | A | | 6/1998 | Derby | |
| 5,788,121 | A | | 8/1998 | Sasaki et al. | |
| 5,788,122 | A | | 8/1998 | Keller | |
| 5,851,072 | A | | 12/1998 | LaFleur | |
| 5,865,541 | A | * | 2/1999 | Lafleur | 383/120 |
| 5,918,984 | A | | 7/1999 | LaFleur et al. | |
| 5,988,422 | A | | 11/1999 | Vallot | |
| 6,032,818 | A | | 3/2000 | Olson | |
| 6,056,681 | A | | 5/2000 | Ross | |
| 6,062,431 | A | | 5/2000 | Geshay | |
| 6,139,482 | A | | 10/2000 | LaFleur et al. | |
| 6,293,432 | B1 | | 9/2001 | Hartwell | |
| 6,371,646 | B1 | * | 4/2002 | LaFleur | 383/109 |
| 6,416,452 | B1 | * | 7/2002 | Meyer | 493/210 |
| 6,527,445 | B2 | * | 3/2003 | LaFleur et al. | 383/37 |
| 6,591,861 | B2 | * | 7/2003 | Liu et al. | 137/434 |
| 6,659,132 | B2 | * | 12/2003 | Smith et al. | 138/89 |
| 6,832,852 | B2 | * | 12/2004 | Wilkes | 383/120 |
| 7,025,318 | B2 | * | 4/2006 | Hurst et al. | 248/331 |
| 7,111,442 | B1 | * | 9/2006 | Van Baal et al. | 53/473 |
| 7,125,168 | B2 | * | 10/2006 | La Fleur et al. | 383/111 |
| 7,147,597 | B2 | * | 12/2006 | Wilkes | 493/212 |
| 7,188,744 | B2 | * | 3/2007 | Hurst et al. | 220/9.2 |
| 7,244,064 | B2 | * | 7/2007 | Sullivan, Jr. | 383/22 |
| 7,384,783 | B2 | * | 6/2008 | Kunas et al. | 435/289.1 |
| 7,407,326 | B2 | * | 8/2008 | Wilkes | 383/120 |
| 7,475,799 | B2 | * | 1/2009 | Schaefer | 224/493 |
| 7,798,711 | B2 | * | 9/2010 | Plunkett et al. | 383/22 |
| 7,980,410 | B2 | | 7/2011 | De Muinck | |
| 8,075,188 | B2 | * | 12/2011 | Plunkett et al. | 383/119 |
| 8,079,492 | B2 | * | 12/2011 | Blomberg | 220/678 |
| 8,182,152 | B2 | * | 5/2012 | Plunkett et al. | 383/105 |
| 8,231,029 | B2 | * | 7/2012 | Peer et al. | 220/754 |
| 8,348,509 | B2 | * | 1/2013 | Wilkes et al. | 383/10 |
| 8,567,660 | B2 | * | 10/2013 | Sullivan et al. | 229/117.3 |
| 8,573,435 | B2 | * | 11/2013 | Blomberg | 220/678 |
| 2006/0180589 | A1 | | 8/2006 | De Muinck | |
| 2009/0297073 | A1 | | 12/2009 | Sondaar | |

FOREIGN PATENT DOCUMENTS

| | | | |
|---|---|---|---|
| DE | 2256913 | A1 | 5/1974 |
| DE | 4204902 | A1 | 8/1992 |
| DE | 4316865 | A1 | 11/1993 |
| DE | 10214712 | A1 | 10/2003 |
| EP | 0493332 | | 7/1992 |
| EP | 0642453 | B1 | 1/1996 |
| GB | 540564 | A | 10/1941 |
| GB | 2117736 | A | 10/1983 |
| JP | 02191171 | | 7/1990 |
| WO | WO 93/13936 | A1 | 7/1993 |
| WO | WO 93/24389 | | 12/1993 |
| WO | WO 2004/022440 | | 3/2004 |
| WO | WO 2004022440 | | 3/2004 |
| WO | WO 2006130008 | A | 12/2006 |

OTHER PUBLICATIONS

Office Action for U.S. Appl. No. 11/916,118, filed Jan. 23, 2009, dated Jul. 26, 2013.
Official Search Report of the European Patent Office Patent Office in counterpart foreign application No. PCT/NL2006/050133 filed Jun. 2, 2006.
Written Opinion of the European Patent Office Patent Office in counterpart foreign application No. PCT/NL2006/050133 filed Jun. 2, 2006.
International Preliminary Examination Report of the European Patent Office for PCT/NL03/00533, filed Jul. 18, 2003.
International Search Report of the European Patent Office for PCT/NL03/00533, filed Jul. 18, 2003.
Office Action for U.S. Appl. No. 10/565,033, filed Jan. 17, 2006, dated Dec. 4, 2008.
Final Office Action for U.S. Appl. No. 10/565,033, filed Jan. 17, 2006, dated Apr. 23, 2009.
Advisory Action for U.S. Appl. No. 10/565,033, filed Jan. 17, 2006, dated Aug. 3, 2009.
Office Action for U.S. Appl. No. 10/565,033, filed Jan. 17, 2006, dated Dec. 18, 2009.
Office Action for U.S. Appl. No. 10/565,033, filed Jan. 17, 2006, dated Oct. 15, 2010.
Notice of Allowance for U.S. Appl. No. 10/565,033, filed Jan. 17, 2006, dated Jul. 2, 2010.
Notice of Allowance for U.S. Appl. No. 10/565,033, filed Jan. 17, 2006, mailed Mar. 17, 2011.
Restriction Requirement for U.S. Appl. No. 11/916,118, filed Nov. 30, 2007, dated Jun. 10, 2011.
Restriction Requirement for U.S. Appl. No. 11/916,118, filed Nov. 30, 2007, dated Jul. 19, 2011.
Office Action for U.S. Appl. No. 11/916,118, filed Nov. 30, 2007, dated Dec. 27, 2011.
Final Office Action for U.S. Appl. No. 11/916,118, filed Nov. 30, 2007, dated Jul. 6, 2012.

* cited by examiner

FOLDABLE BAG AND A METHOD OF MANUFACTURING A FOLDABLE BAG

CROSS-REFERENCE TO RELATED APPLICATION

This Application is a Section 371 National Stage Application of International Application No. PCT/EP2010/055838, filed Apr. 29, 2010 and published as WO 2010/125152 A1 on Nov. 4, 2010, in English.

BACKGROUND

The discussion below is merely provided for general background information and is not intended to be used as an aid in determining the scope of the claimed subject matter.

Aspects of the present invention relate to a foldable bag.

A foldable bag is known from WO 2006/130008 of the same applicant as the present application. The known bag appears to provide great advantages in effective unfolding during filling the bag.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

A bag according to an aspect of the invention, comprises an unfolded condition in which the bag has a front sheet and a back sheet which are circumferentially joined to each other, and in which condition the bag has a bottom edge and an opposite top edge, and opposite side edges extending between the top edge and the bottom edge, wherein the bottom edge includes an inner bottom edge portion and outer bottom edge portions located at opposite sides of the inner bottom edge portion and extending up to the respective side edges, and a folded condition in which the bag has a reversed T-shape including a bottom and an upward portion extending upwardly from the bottom, wherein in the folded condition of the bag at the upward portion the side edges are inwardly creased between the front sheet and the back sheet such that they face to each other, and at the bottom the inner bottom edge portion extends substantially within the plane of the upward portion and each of the outer bottom edge portions extend substantially parallel above the inner bottom edge portion.

The bottom of the reversed T-shaped bag will be a substantially flat portion and can be placed in a box on the bottom thereof without fixing the bag to the box. The upward portion of the bag may be provided with a filling opening to supply a fluid into the bag. It appears that the bag can be filled very effectively due to efficient unfolding of the bag during filling. Due to the reversed T-shape of the bag in folded condition the bag can be placed in a stable manner on the bottom of a box. In practice the bag is flexible and the upward portion must probably be supported to create the reversed T-shape at the start of filling the bag.

In one embodiment, the length of the lower fold line portions is smaller than the length of the outer bottom edge portions since this creates a symmetrical rectangular bottom.

In the unfolded condition the bag may only have the front sheet and the back sheet which are circumferentially joined to each other. The front sheet and/or the back sheet themselves may be made of a plurality of sheet layers, but it means that in case of a filled bag a fluid is present between the front and back sheets. In the entirely unfolded condition the bag is not provided with inwardly creased bag portions that are fixed to the front sheet and/or bag sheet.

It is noted that the rectangular bottom may also be a square bottom. In this case the length of the lower fold line portions is substantially the same as the length of the outer bottom edge portions, and the length of each of the outer bottom edge portions is substantially half of the length of the inner bottom edge portion.

An aspect of the invention also relates to a method of manufacturing a foldable bag for use in a bag-in-box assembly, comprising the steps of supplying a bag in a partly folded condition in which condition the bag includes a bottom edge and a top edge opposite to each other, and inwardly creased bag portions facing to each other and extending between the bottom edge and the top edge, wherein each of the inwardly creased bag portions has an upper closed end located near the top edge and a lower closed end located near the bottom edge, wherein the upper closed end and the lower closed end are free ends, displacing side edge portions located at a predetermined distance from the bottom edge at entrances of the inwardly creased portions away from each other. Due to this method of manufacturing a reversed T-shaped bag including a bottom and an upward portion projecting from the bottom is obtained. The upper closed end and lower closed end of the supplied bag are not fixed to the bottom edge and the top edge.

BRIEF DESCRIPTION OF THE DRAWINGS

Aspects of the invention will hereafter be elucidated with reference to the very schematic drawings showing embodiments of the invention by way of example.

DETAILED DESCRIPTION OF THE ILLUSTRATIVE EMBODIMENTS

Figure 1:
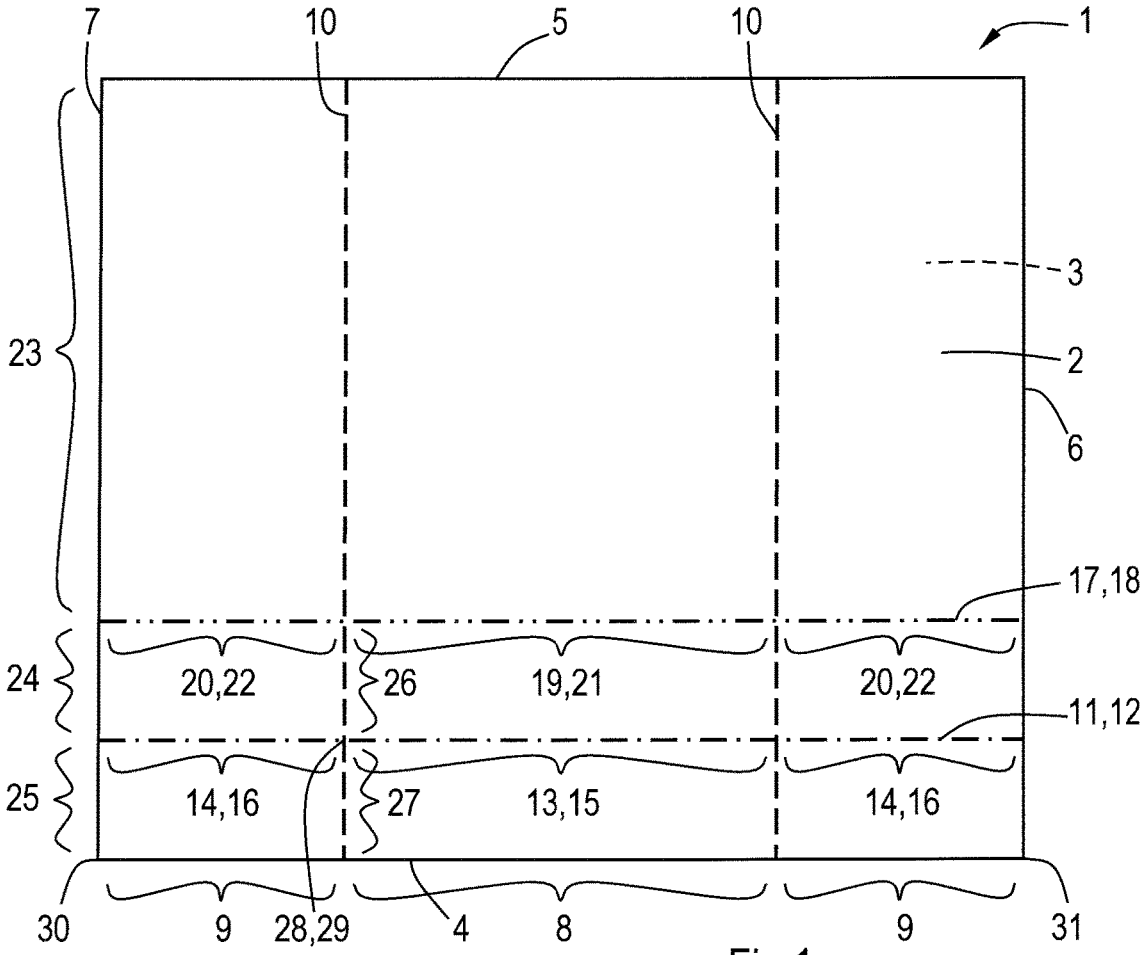
FIG. 1 is a front view of an embodiment of the foldable bag, illustrating the bag in an entirely unfolded condition.
Figure 4:
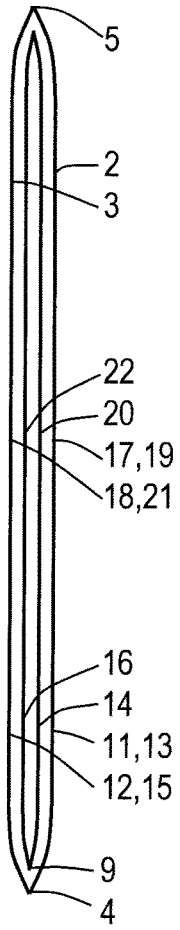
FIG. 4 is a sectional view of the embodiment of FIG. 2 along the line IV-IV.
Figure 5:
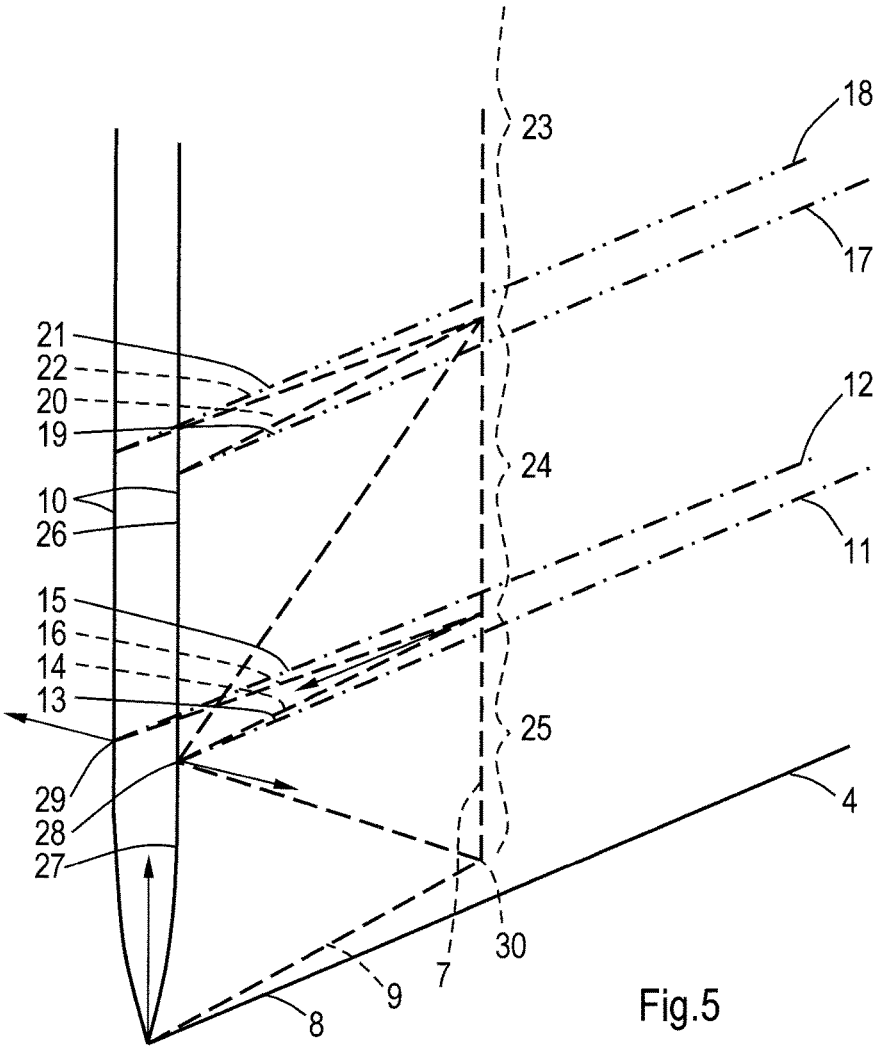
FIG. 5 is a perspective view of a part of the embodiment of FIG. 2, illustrating by means of arrows a step of an embodiment of the method of manufacturing the foldable bag.
Figure 6:
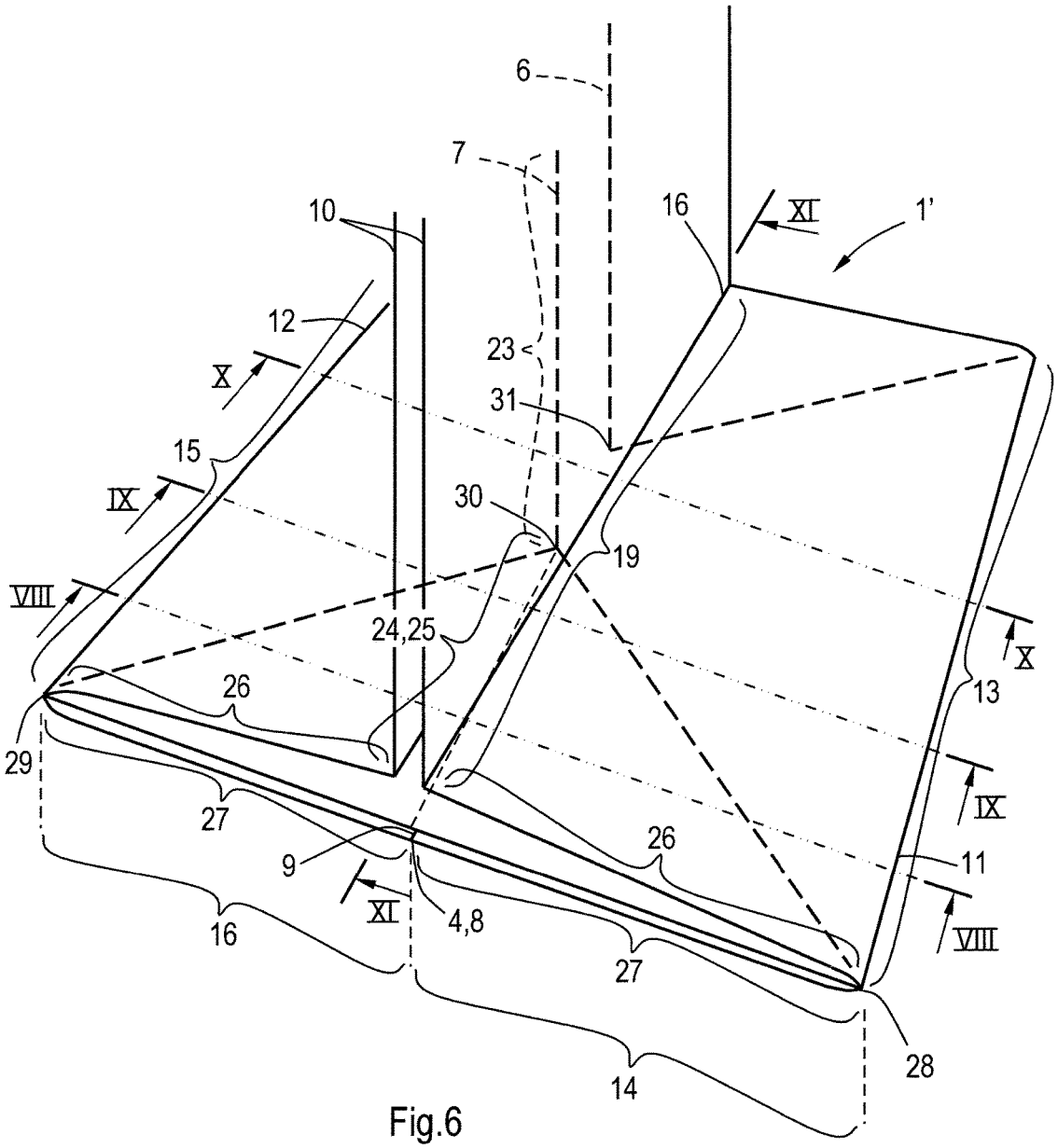
FIG. 6 is a perspective view of a part of the embodiment of the bag, illustrating the bag in a folded condition.

FIGS. 1-6 illustrate several steps of an embodiment of a method of manufacturing a foldable bag 1' in order to obtain the foldable bag 1'. FIG. 1 shows the bag 1 in an entirely unfolded condition, FIGS. 2-5 show the bag 1 in a partly folded condition and FIG. 6 shows the bag 1' in a folded condition. It is noted that alternative embodiments of manufacturing methods are conceivable to obtain the bag 1' in the folded condition as shown in FIG. 6. FIGS. 7-11 show different views of the bag 1' in the folded condition.

In the unfolded condition the bag 1 has a front sheet 2 and a back sheet 3 which are circumferentially joined to each other, see FIG. 1. The front sheet 2 and back sheet 3 may be joined by a circumferential welding seam, but it is also possible that at least one of the edges is a fold instead of a welding seam. The bag 1 has a bottom edge 4 and an opposite top edge 5, and opposite side edges 6, 7 extending between the top and bottom edges 5, 4. The bottom edge 4 includes an inner bottom edge portion 8 and two outer bottom edge portions 9 located at opposite sides of the inner bottom edge portion 8 and extending up to the respective side edges 6, 7. In the unfolded condition this embodiment of the bag 1 has a substantially rectangular shape.

Figure 2:
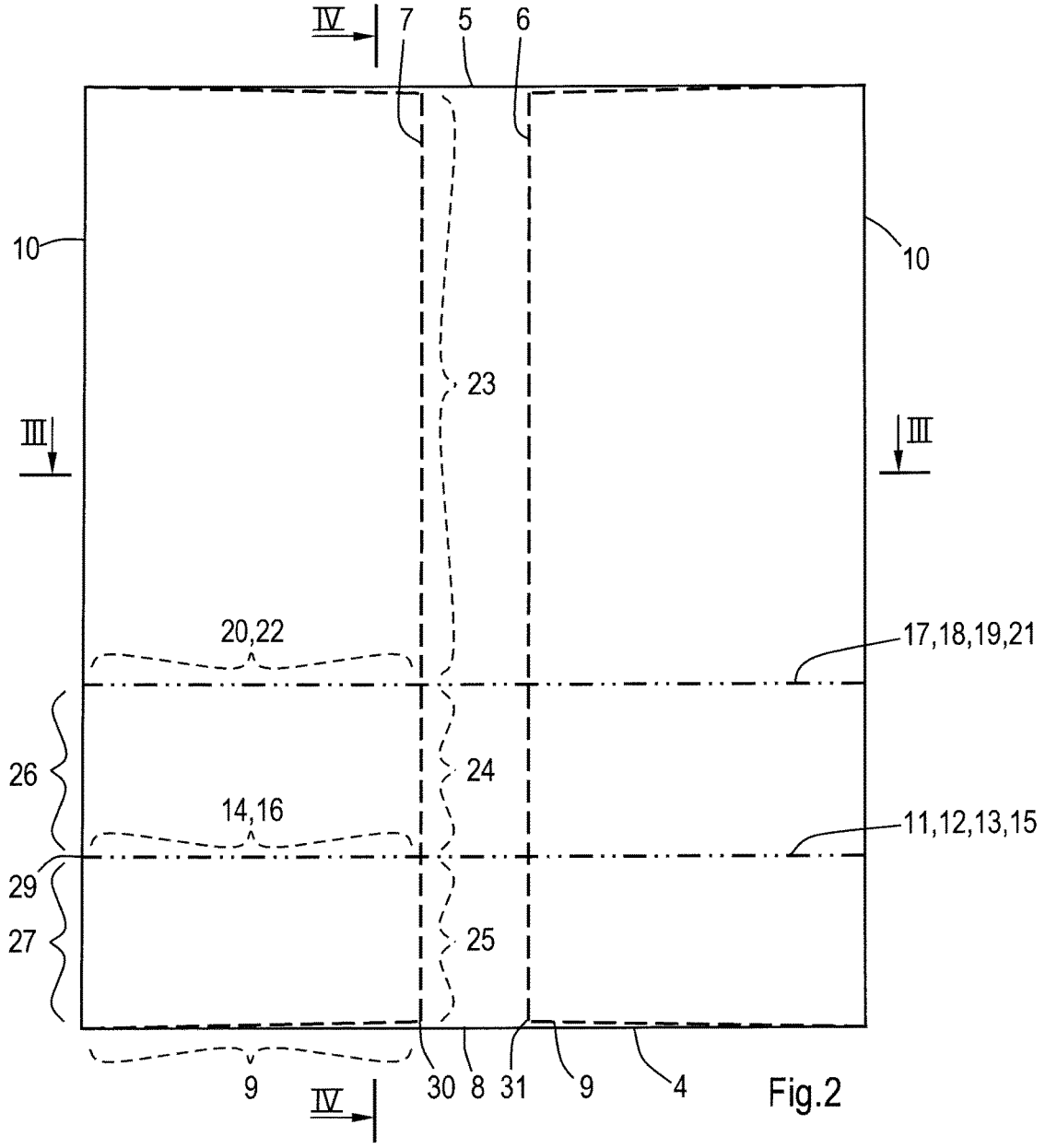
FIG. 2 is the same view as FIG. 1, showing a partly folded condition of the bag on a larger scale.
Figure 3:
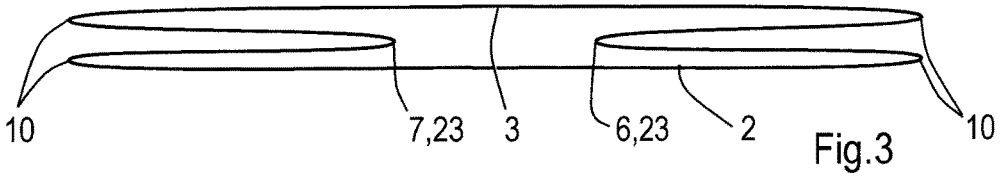
FIG. 3 is a sectional view of the embodiment of FIG. 2 along the line III-III.

In the unfolded condition of the bag 1 as shown in FIG. 1 two parallel fold lines 10 extending parallel to the side edges 6, 7 illustrate the locations at which bag portions adjacent to the side edges 6, 7 are folded inwardly in a next step of the manufacturing method. In reality there are two fold lines 10 on the front sheet 2 and two fold lines 10 on the back sheet 3. The distance between a pair of fold lines 10 on the front sheet 2 and the back sheet 3 closest to one side edge 6 and that side edge 6 is substantially the same as the distance between a pair of fold lines 10 on the front sheet 2 and the back sheet 3 closest to the opposite side edge 7 and that side edge 7 in the unfolded condition of the bag 1. The resulting condition of the partly folded bag 1 after inwardly folding is shown in FIG. 2. It can be seen that the side edges 6, 7 are displaced inwardly between the front sheet 2 and the back sheet 3 so as to form inwardly creased bag portions. A manner of inwardly displacing the side edges 6, 7 is described in WO 2006/130008. In the condition as shown in FIG. 2 the outer bottom edge portions 9 of the bottom edge 4 form free ends near the inner bottom edge portion 8 and are not fixed thereto. The side edges 6, 7 face toward each other in the partly folded condition of the bag 1. FIGS. 3 and 4 show cross-sectional views of the bag 1 in the condition as shown in FIG. 2. It can be seen in FIG. 2 that the fold lines 10 form side edges of the bag 1 in the partly folded condition extending between the top edge 5 and the bottom edge 4.

FIG. 5 shows a part of the bag 1 in the condition of FIGS. 2-4 in a perspective view. The arrows illustrate the direction of displacement of several parts of the bag 1 in a next manufacturing step. A perspective view of the resulting bag 1' in the folded condition is shown in FIG. 6. In the folded condition the bag 1' has a reversed T-shape including a substantially rectangular bottom in this case. The bottom forms a substantially flat portion of the bag 1' in the folded condition. In the folded condition the bag 1' can be easily placed on a rectangular bottom of an appropriate box so as to form a bag-in-box assembly. The reversed T-shaped bag 1' has an upward portion which extends upwardly from its bottom. Of course, the material of the foldable bag 1' can be flexible such that the upward portion will not automatically stand upright from the bottom of the bag 1', but has to be supported to create the shape as shown in FIG. 6. In other words, the plane of the upward portion does not necessarily extend perpendicularly to the plane of the bottom in the folded condition. At the upward portion bag portions adjacent to the side edges 6, 7 are still inwardly creased such that the side edges 6, 7 face to each other. At the bottom of the bag 1' in the folded condition the front sheet 2 and the bag sheet 3 are folded rather complicated which will be clarified below.

For clarity reasons portions of the bag 1 in partly folded condition as shown in FIGS. 2-5 are indicated by the same reference signs as corresponding portions in FIG. 6. FIGS. 1, 2, 4 and 5 show a first front sheet fold line 11 on the front sheet 2 and a first back sheet fold line 12 on the back sheet 3. In the entirely unfolded condition of the bag 1 the first front sheet fold line 11 and the first back sheet fold line 12 extend substantially perpendicularly to the side edges 6, 7 at a first distance from the bottom edge 4, see FIG. 1. The first front sheet fold line 11 comprises an inner first front sheet fold line portion 13 and two outer first front sheet fold line portions 14 extending at opposite sides of the inner first front sheet fold line portion 13 up to the side edges 6, 7 in the entirely unfolded condition. The first back sheet fold line 12 comprises an inner first back sheet fold line portion 15 and two outer first back sheet fold line portions 16 extending at opposite sides of the inner first back sheet fold line portion 15 up to the side edges 6, 7 in the entirely unfolded condition.

Similarly to the first front and back sheet fold lines 11, 12, respectively, the bag 1 in the unfolded condition also comprises a second front sheet fold line 17 on the front sheet 2 and a second back sheet fold line 18 on the back sheet 3. The second front and back sheet fold lines 17, 18 extend substantially parallel to the first front and back sheet fold lines 11, 12 at a distance from the bottom edge 4 which is substantially twice the first distance. The second front sheet fold line 17 comprises an inner second front sheet fold line portion 19 and two outer second front sheet fold line portions 20 extending at opposite sides of the inner second front sheet fold line portion 19 up to the side edges 6, 7 in the entirely unfolded condition. The second back sheet fold line 18 comprises an inner second back sheet fold line portion 21 and two outer second back sheet fold line portions 22 extending at opposite sides of the inner second back sheet fold line portion 21 up to the side edges 6, 7 in the entirely unfolded condition.

The side edge 7 comprises an upper side edge portion 23, an intermediate side edge portion 24 and a lower side edge portion 25. In the entirely unfolded condition the upper side edge portion 23 extends between the top edge 5 and the second front and back sheet fold lines 17, 18, the intermediate side edge portion 24 extends between the second front and back sheet fold lines 17, 18 and the first front and back sheet fold lines 11, 12, and the lower side edge portion 25 extends between the first front and back sheet fold lines 11, 12 and the bottom edge 4. The lengths of the intermediate side edge portion 24 and the lower side edge portion 25 are substantially the same.

Each of the fold lines 10 comprises an intermediate fold line portion 26 and a lower fold line portion 27. Referring to FIG. 1, the intermediate fold line portions 26 of the front sheet 2 and the back sheet 3 extend between the second front and back sheet fold lines 17, 18 and the first front and back sheet fold lines 11, 12, respectively, and the lower fold line portions 27 of the front sheet 2 and the back sheet 3 extend between the first front and back sheet fold lines 11, 12 and the bottom edge 4, respectively.

When comparing the bag 1 in unfolded or partly folded condition as shown in FIGS. 1-5 with the bag 1' in the folded condition as shown in FIGS. 6-11 it can be observed that the inner first front sheet fold line portion 13 and the inner first back sheet fold line portion 15 form opposite bottom side edges of the bottom of the bag 1' in the folded condition. The inner first front sheet fold line portion 13 and the inner first back sheet fold line portion 15 extend substantially parallel to a plane of the upward portion of the reversed T-shape. Each of the other opposite edges of the rectangular bottom of the bag 1' in the folded condition are formed by three edge portions on each other: the lower fold line portions 27 of the front and back sheets 2, 3 at the lower edge portion, the intermediate fold line portions 26 at the upper edge portion, and outer first front and back sheet fold line portions 14, 16 extending between the lower and upper edge portions.

FIG. 6 shows two opposite corner locations 28, 29 which are intersections of the first front sheet fold line 11 and a fold line 10 on the front sheet 2 and the first back sheet fold line 12 and a fold line 10 on the back sheet 3, respectively, in the entirely unfolded condition. FIG. 5 illustrates that the reversed T-shape bag 1' can be manufactured by displacing the corner locations 28, 29 of the bag 1 in partly folded condition away from each other. As a consequence, the inner bottom edge portion 8 moves in the direction of the inner second front and back sheet fold line portions 19, 21. At the same time a joint portion of the intermediate side edge portion 24 and the lower side edge portion 25 moves in outward direction of the bag 1 towards the fold lines 10 such that the intermediate side edge portion 24 and the lower side edge portion 25 lie onto each other in the folded condition. Preferably, the distance between the inner bottom portion 8 and the corner locations 28, 29 is shorter than the length of the outer bottom edge portion 9 in order to obtain an appropriate bottom in the folded condition of the bag 1'.

FIG. 1 shows initial corners 30, 31 at which the side edges 6, 7 of the bag 1 in the unfolded condition intersect the bottom edge 4. In the folded condition as shown in FIG. 6 the initial corners 30, 31 face to each other. In this condition the intermediate side edge portion 24 and the lower side edge portion 25 of each side edge 6, 7 lie on each other and extend substantially within the plane of the upward portion.

Figure 7:
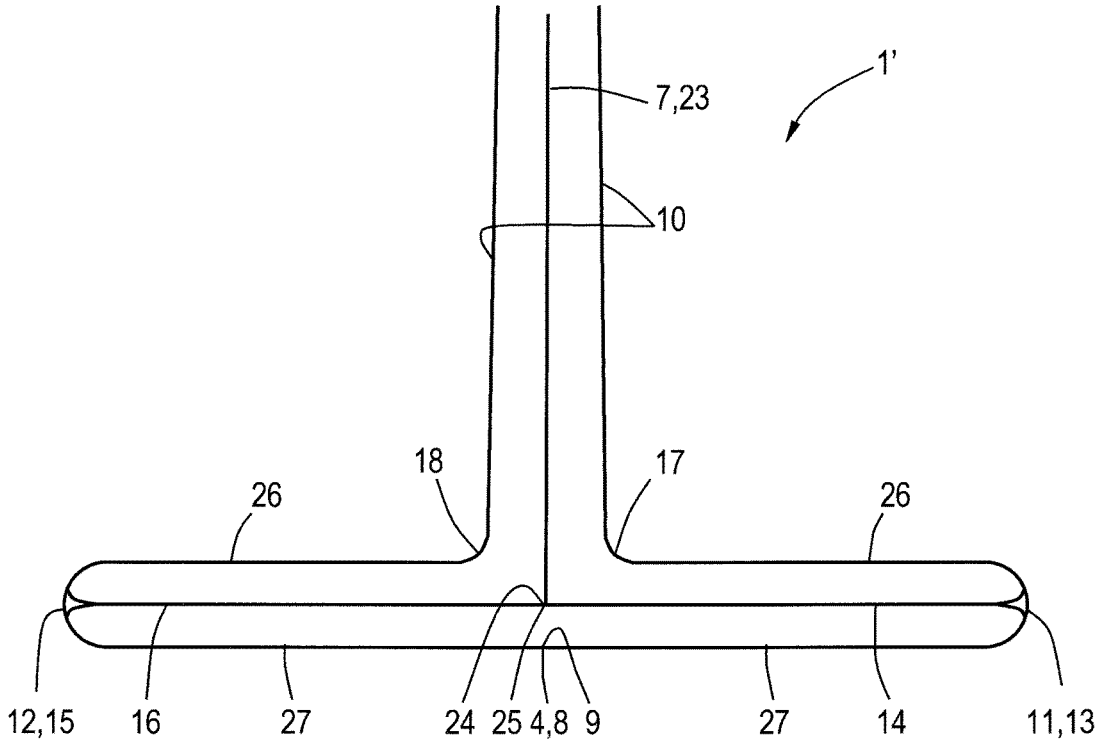
FIG. 7 is a side view of the embodiment as shown in FIG. 6.

FIG. 7 is a side view of the reversed T-shaped bag 1' in the folded condition. This side view shows the side edge 7, or more specifically the upper side edge portion 23 at the end of the inwardly creased bag portion. The upper side edge portion 23 extends substantially parallel to the fold lines 10 in the upward portion. The side view of the bottom of the reversed T-shaped bag 1' shows the three edge portions of the bottom, as mentioned hereinbefore, stacked on each other: the lower fold line portions 27 at the lower edge portion, the intermediate fold line portions 26 at the upper edge portion, and the outer first front and back sheet fold line portions 14, 16 extending between the lower and upper edge portions.

Figure 8:
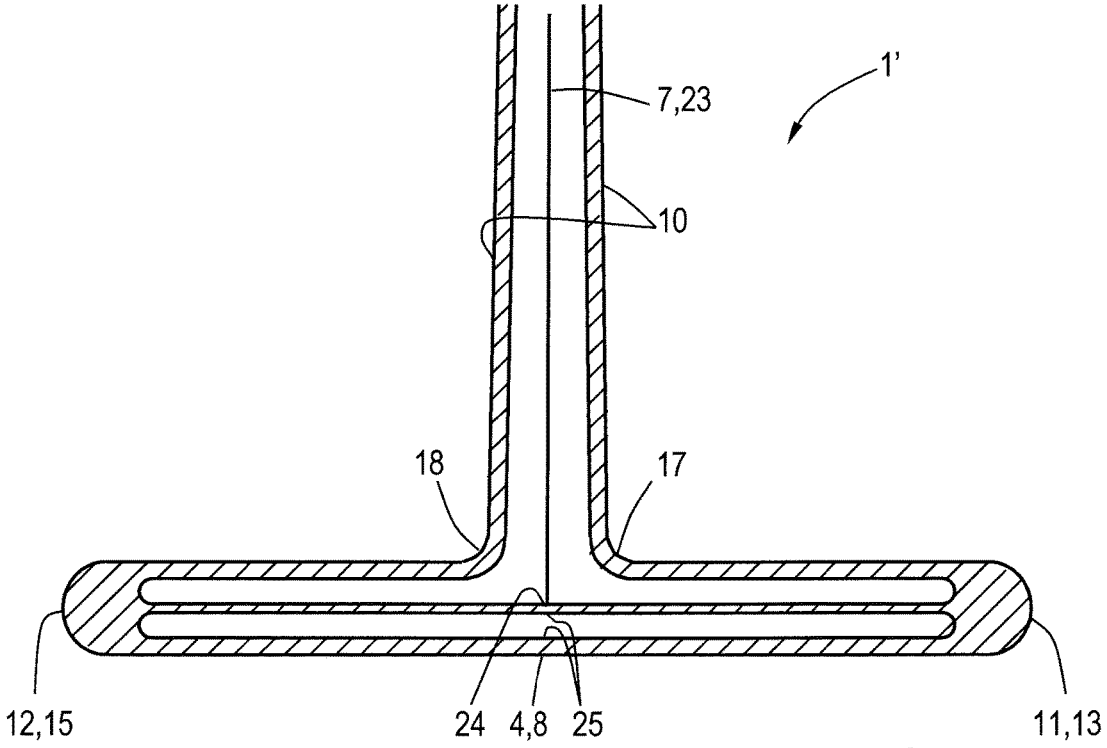
FIG. 8 is a sectional view of the embodiment of FIG. 6 along the plane VIII-VIII.
Figure 9:
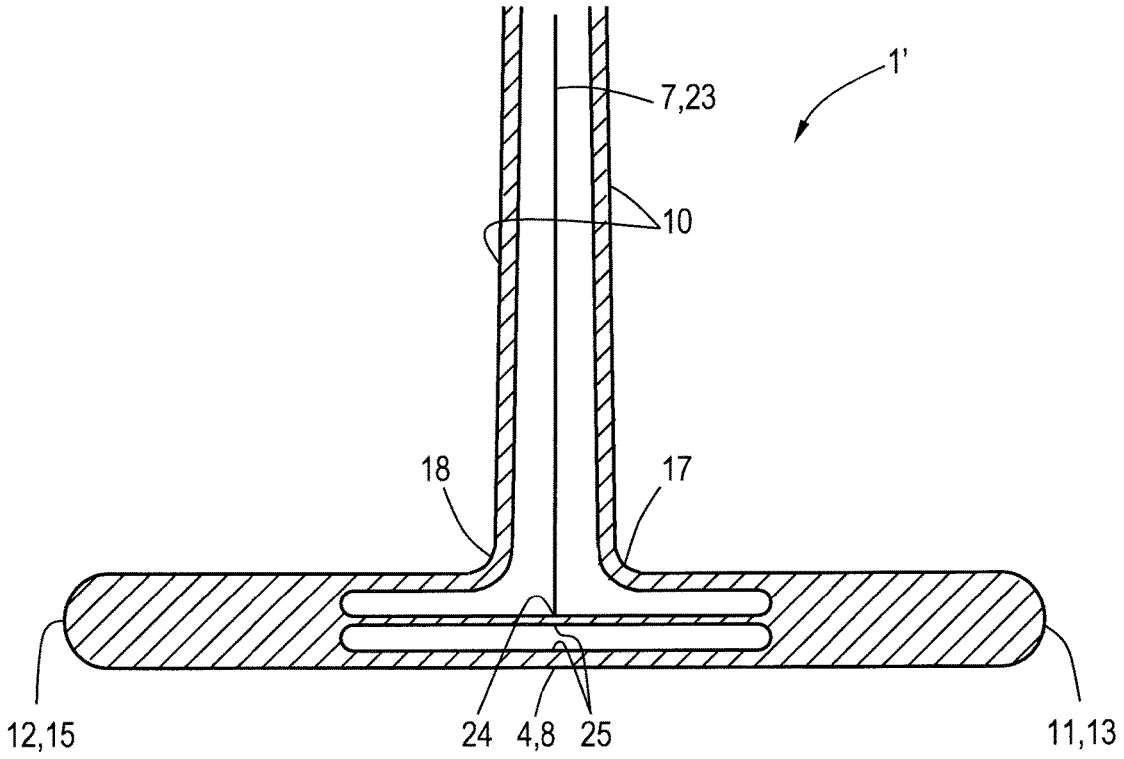
FIG. 9 is a sectional view of the embodiment of FIG. 6 along the plane IX-IX.

FIGS. 8 and 9 show cross-sectional views of the bag 1' in the folded condition. It can be seen that in a part of the bottom several layers of the front sheet 2 and the back sheet 3 are located on each other. The width of the layers decreases in the direction of a center of the bottom, see FIG. 9, and the stack of layers is away at the center, see FIG. 10. For clarity reasons, in FIGS. 8 and 9 certain portions are hatched to indicate the inner space of the bag 1'. The hatched portions do not illustrate a cross sectional area of the front or back sheets 2, 3, but only indicate an imaginary fluid, hence spaces where fluid can be present when filling the bag 1'. Spaces without hatching are parts where no fluid can be present when filling the bag 1'; from these spaces the outer side of the bag 1 in unfolded condition is seen.

Figure 10:
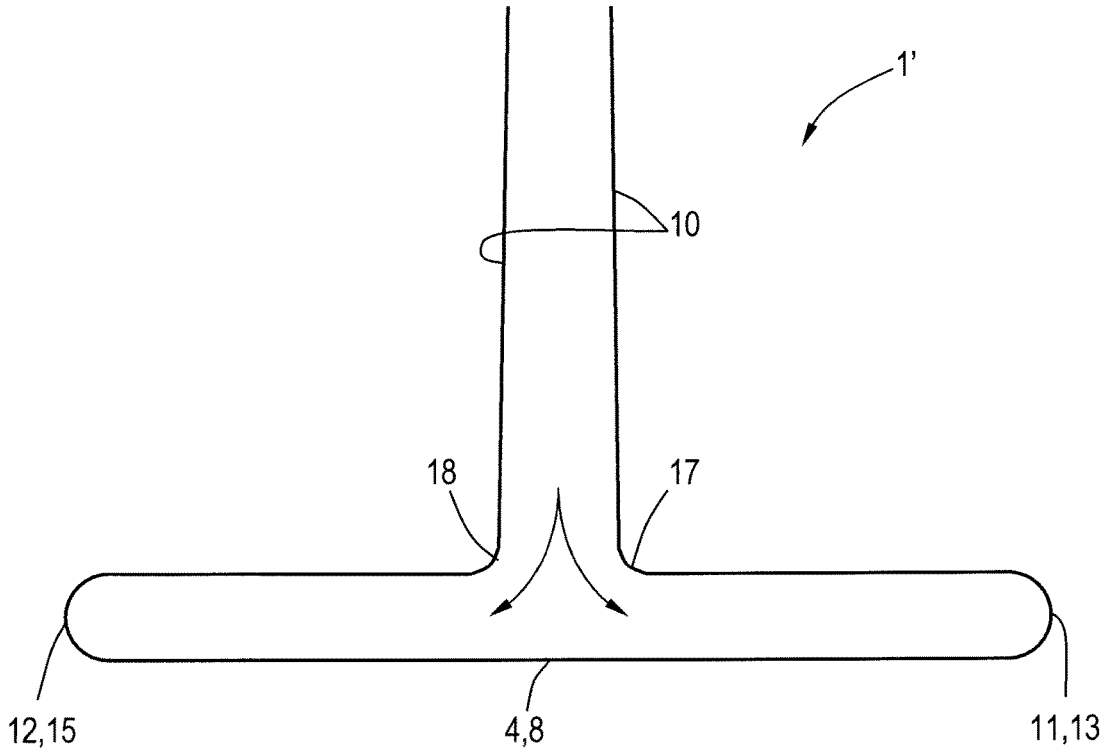
FIG. 10 is a sectional view of the embodiment of FIG. 6 along the plane X-X.
Figure 11:
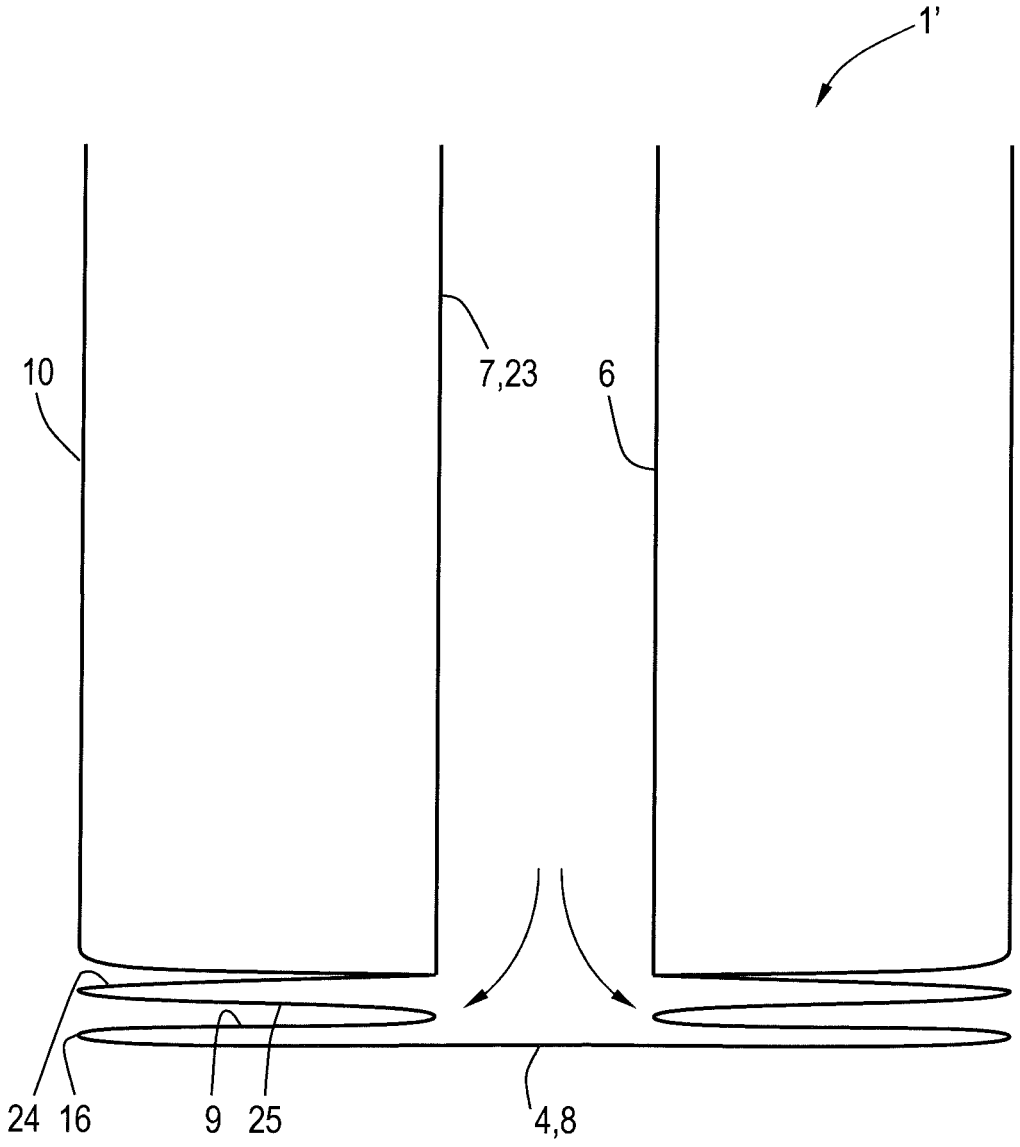
FIG. 11 is a sectional view of the embodiment of FIG. 6 along the plane XI-XI.

FIG. 11 also shows a cross-sectional view of the bag 1' in folded condition, but perpendicular to the view according to FIG. 10. FIGS. 10 and 11 illustrate that when the bag in folded condition 1' is filled by a fluid at a center portion between the side edges 6, 7 in the upward portion the fluid flows downwardly through a channel which is formed between the front sheet 2, the back sheet 3 and the upper side edge portions 23 to the center of the bottom. From there the fluid can easily spread over the bottom since there are no barriers. The fluid can also flow below the stack of folded layers of the front sheet 2 and the back sheet 3 at the bottom as shown in FIG. 11. This means that upon filling, the stacks of layers are automatically pushed upwardly such that the bag 1' unfolds in an effective way. During filling, the upward portion may be hold upwardly. Of course, a filling and/or emptying opening may be located at a different location of the bag 1'.

It is noted that the mutual displacement of portions of the front and back sheets 2, 3 of the bag 1 from the partly folded condition as shown in FIG. 5 to the folded condition as shown in FIG. 6 is facilitated when the bag 1 is empty or substantially vacuum.

It is also noted that the rectangular bottom may also be a square bottom. In this case the lengths of the intermediate fold line portions 26 and the lower fold line portions 27 are substantially the same as the length of the outer bottom edge portions 9, and the length of each of the outer bottom edge portions 9 is substantially half of the length of the inner bottom edge portion 8. This means that in the partly folded condition of the bag 1 as shown in FIG. 2 the side edges 6, 7 are substantially adjacent to each other.

From the foregoing, it will be clear that the invention provides a foldable bag which can be effectively filled. Besides, stress concentrations in welding seams after filling of the bag, such as in case of known foldable bags, are avoided. Such stress concentrations typically occur in case of a foldable bag which is also provided with inwardly creased bag portions, but wherein the inwardly creased bag portions are also welded to the bottom edge and/or top edge of the bag in an unfolded condition thereof.

The invention is not limited to the embodiments shown in the drawings and described hereinbefore, which may be varied in different manners within the scope of the claims and their technical equivalents. Although the drawings do not show filling or emptying openings, these may be provided on the bag, preferably at a center at the top of the upward portion of the bag in folded condition.

The invention claimed is:

1. A foldable bag, comprising a front sheet and a back sheet circumferentially joined to each other in an unfolded condition wherein in the unfolded condition the bag has a bottom edge and an opposite top edge, and opposite side edges extending between the top edge and the bottom edge, wherein the bottom edge includes an inner bottom edge portion and outer bottom edge portions located at opposite sides of the inner bottom edge portion and extending up to the respective side edges, and wherein the bottom edge and opposing side edges join the front sheet directly to the back sheet and to define a cavity for fluid, so that the entirety of the back sheet is directly overlying the front sheet throughout the cavity;

and wherein in a folded condition in which the bag has a reversed T-shape including a bottom and an upward portion extending upwardly from the bottom, wherein in the folded condition of the bag at the upward portion the side edges are inwardly creased between the front sheet and the back sheet such that they face to each other, and at the bottom the inner bottom edge portion extends substantially within the plane of the upward portion and each of the outer bottom edge portions extend substantially parallel above the inner bottom edge portion whereupon filling of the bag in the folded condition returns the bag to the unfolded condition.

2. The foldable bag according to claim 1, wherein the bottom of the bag in folded condition is substantially rectangular.

3. The foldable bag according to claim 1, wherein in the unfolded condition the side edges extend substantially perpendicularly to the bottom edge and intersect the bottom edge at respective initial corners, wherein the initial corners face toward each other in the folded condition.

4. The foldable bag according to claim 1, wherein in the unfolded condition a first front sheet fold line and a first back sheet fold line extending perpendicularly to the side edges at a first distance from the bottom edge are defined on the front sheet and the back sheet, respectively, wherein the first front sheet fold line comprises an inner first front sheet fold line portion and outer first front sheet fold line portions extending at opposite sides of the inner first front sheet fold line portion and extending up to the respective side edges, whereas the first back sheet fold line comprises an inner first back sheet fold line portion and outer first back sheet fold line portions extending at opposite sides of the inner first back sheet fold line portion and extending up to the respective side edges, and wherein a second front sheet fold line and a second back sheet fold line extending perpendicularly to the side edges at substantially twice the first distance from the bottom edge are defined, wherein the inner first front sheet fold line portion and the inner first back sheet fold line portion form opposite bottom side edges of the bottom of the bag in the folded condition, which inner first front and back sheet fold line portions extend substantially parallel to the plane of the upward portion of the reversed T-shape, and wherein one of the outer first front sheet fold line portions together with one of the outer first back sheet fold line portions which are adjacent to each other in the unfolded condition, form a bottom side edge of the bottom of the bag in the folded condition extending perpendicularly to the plane of the upward portion.

5. The foldable bag according to claim 4, wherein in the unfolded condition of the bag each of the side edges comprises an upper side edge portion extending between the top edge and the second front and back sheet fold lines, an intermediate side edge portion extending between the second front and back sheet fold lines and the first front and back sheet fold lines, and a lower side edge portion extending between the first front and back sheet fold lines and the bottom edge, wherein in the folded condition of the bag the upper side edge portions are present at the upward portion, and the intermediate side edge portion and the lower side edge portion of each of the side edge substantially lie onto each other at the bottom substantially in the plane of the upward portion.

6. The foldable bag according to claim 4, wherein the bag in the unfolded condition comprises a pair of substantially parallel fold lines on the front sheet and the back sheet at a predetermined distance of one of the side edges and a pair of substantially parallel fold lines on the front sheet and the back sheet at a predetermined distance of the opposite side edge, the fold lines extending substantially parallel to the side edges, wherein in the folded condition of the bag both pairs of fold lines form side edges of the bag at the upward portion, whereas a bag portion extending between a pair of fold lines and the closest side edge thereof in the unfolded condition is folded inwardly at the upward portion in the folded condition, wherein in the unfolded condition each of the fold lines comprises an intermediate fold line portion extending between the second front and back sheet fold lines and the first front and back sheet fold lines, and a lower fold line portion extending between the first front and back sheet fold lines and the bottom edge, wherein in the folded condition the lower fold line portions form lower side edges of the bottom of the bag extending substantially perpendicularly to the plane of the upward portion and the intermediate fold line portions form upper side edges of the bottom of the bag extending substantially parallel above the lower side edges.

7. The foldable bag according to claim 6, wherein the distance from the one side edge to the closest pair of fold lines is substantially the same as the distance from the opposite side edge to the pair of fold lines closest thereto.

8. The foldable bag according to claim 6, wherein the length of the lower fold line portions is smaller than the length of the outer bottom edge portions.

9. The foldable bag according to claim 1, wherein the bag in the unfolded condition only has the front sheet and the back sheet which are circumferentially joined to each other.

10. A foldable bag comprises a front sheet and a back sheet which are circumferentially joined to each other in an unfolded condition wherein the bag is disposed in a folded condition in which the bag has a reversed T-shape including a bottom and an upward portion extending upwardly from the bottom, and wherein in the folded condition of the bag, upward portion side edges are inwardly creased between the front sheet and the back sheet such that they face to each other, and wherein at the bottom, an inner bottom edge portion extends substantially within a plane of the upward portion and each of outer bottom edge portions extend substantially parallel above the inner bottom edge portion whereupon filling of the bag in the folded condition returns the bag to the unfolded condition.

11. A foldable bag comprises a front sheet and a back sheet which are circumferentially joined to each other in an unfolded condition wherein the bag is disposed in a folded condition wherein the bag includes a bottom edge and a top edge opposite to each other, and inwardly creased bag portions facing toward each other and extending between the bottom edge and the top edge, wherein each of the inwardly creased bag portions has an upper closed end located near the top edge and a lower closed end located near the bottom edge, wherein the upper closed end and the lower closed end are free ends, and wherein side edge portions are displaced from each other and located at a predetermined distance from the bottom edge at entrances of the inwardly creased portions away from each other whereupon filling of the bag in the folded condition returns the bag to the unfolded condition.

* * * * *